US008025391B2

(12) United States Patent
Nakayama

(10) Patent No.: US 8,025,391 B2
(45) Date of Patent: Sep. 27, 2011

(54) INKJET RECORDING APPARATUS

(75) Inventor: Koji Nakayama, Seki (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 842 days.

(21) Appl. No.: 11/782,717

(22) Filed: Jul. 25, 2007

(65) Prior Publication Data

US 2008/0024580 A1 Jan. 31, 2008

(30) Foreign Application Priority Data

Jul. 31, 2006 (JP) ..... 2006-208692

(51) Int. Cl.
*B41J 2/01* (2006.01)

(52) U.S. Cl. ..... 347/104; 399/110

(58) Field of Classification Search ..... 347/84–86, 347/89, 95, 100–101, 104–106; 101/450.1, 101/473.1, 483; 271/8.1, 198, 264, 272–3, 271/278; 399/361, 381, 388; 429/32.36
See application file for complete search history.

(56) References Cited

U.S. PATENT DOCUMENTS 5,418,606 A * 5/1995 Kikuchi et al. ..... 399/381
5,520,766 A * 5/1996 Iwasaki ..... 156/277
5,739,509 A * 4/1998 Watanabe ..... 235/379
5,896,157 A * 4/1999 Fisher, Sr. ..... 347/171
5,966,836 A * 10/1999 Valdez et al. ..... 34/448
6,234,626 B1 * 5/2001 Axtell et al. ..... 347/108
6,253,056 B1 * 6/2001 Lindblad et al. ..... 399/352
6,259,882 B1 * 7/2001 Lindblad et al. ..... 399/352
6,281,912 B1 * 8/2001 Silverbrook ..... 347/42
6,292,637 B1 * 9/2001 Lindblad et al. ..... 399/99
6,419,411 B1 * 7/2002 Tanno ..... 400/635
6,698,877 B2 * 3/2004 Urlaub et al. ..... 347/103
(Continued)

FOREIGN PATENT DOCUMENTS

JP 59100737 U * 7/1984
(Continued)

OTHER PUBLICATIONS

Notification of Reasons for Refusal for Japanese Patent Application No. 2006-208692, date May 15, 2008.

*Primary Examiner* — Charlie Peng
*Assistant Examiner* — Peter Radkowski
(74) *Attorney, Agent, or Firm* — Baker Botts L.L.P.

(57) ABSTRACT

There is disclosed an inkjet recording apparatus including a feeding device, a medium supply device, a remover, and an inkjet head. The feeding device includes a plurality of belt rollers and an endless feeder belt wound around the belt rollers. An outer circumferential surface of the feeder belt functions as a feeding surface on which a recording medium is held while the recording medium is fed. The medium supply device makes the recording medium held on a downward-facing surface of the feeder belt with a recording surface of the recording medium facing downward. The downward-facing surface is a portion of the feeding surface which faces downward. The remover removes foreign matter on the recording surface of the recording medium as being held on the downward-facing surface. The inkjet head has a nozzle from which a droplet of ink is ejected onto the recording surface of the recording medium as being held on an upward-facing surface of the feeder belt. The upward-facing surface is a portion of the feeding surface which faces upward.

21 Claims, 2 Drawing Sheets

U.S. PATENT DOCUMENTS

| | | | | |
|---|---|---|---|---|
| 6,890,053 | B2 * | 5/2005 | Myhill et al. | 347/25 |
| 7,018,117 | B2 * | 3/2006 | Meier et al. | 400/208 |
| 2002/0180853 | A1 * | 12/2002 | Ohsawa et al. | 347/95 |
| 2004/0028436 | A1 * | 2/2004 | Suzuki et al. | 399/381 |
| 2004/0189744 | A1 * | 9/2004 | Myhill et al. | 347/34 |
| 2005/0087923 | A1 * | 4/2005 | Inoue | 271/264 |
| 2005/0128280 | A1 * | 6/2005 | Johnson et al. | 347/187 |
| 2005/0140744 | A1 * | 6/2005 | Iwao | 347/68 |
| 2006/0023021 | A1 * | 2/2006 | Shimizu | 347/34 |
| 2006/0033968 | A1 * | 2/2006 | Maki | 358/498 |
| 2006/0098074 | A1 | 5/2006 | Nakashima | |
| 2006/0114305 | A1 * | 6/2006 | Ohtsu et al. | 347/102 |

FOREIGN PATENT DOCUMENTS

| | | | | |
|---|---|---|---|---|
| JP | H59-100737 | U | | 7/1984 |
| JP | 01141075 | A | * | 6/1989 |
| JP | H11-41075 | A | | 6/1989 |
| JP | 01188382 | A | * | 7/1989 |
| JP | 02188332 | A | * | 7/1990 |
| JP | 03044134 | A | * | 2/1991 |
| JP | 3044134 | U | * | 4/1991 |
| JP | H03-44134 | U | | 4/1991 |
| JP | 04053752 | A | * | 2/1992 |
| JP | H04-053752 | A | | 2/1992 |
| JP | 04327949 | A | * | 11/1992 |
| JP | 10324432 | A | * | 12/1998 |
| JP | H10-324432 | A | | 12/1998 |
| JP | 2000095374 | A | * | 4/2000 |
| JP | 2003165230 | A | * | 6/2003 |
| JP | 2003311946 | A | * | 11/2003 |
| JP | 2006013153 | A | | 1/2006 |
| JP | 2006131353 | A | * | 5/2006 |

* cited by examiner

INKJET RECORDING APPARATUS

CROSS REFERENCE TO RELATED APPLICATION

The present application claims priority from Japanese Patent Application No. 2006-208692, which was filed on Jul. 31, 2006, the disclosure of which is herein incorporated by reference in its entirety.

BACKGROUND OF THE INVENTION

1. Field of the Invention

The present invention relates to an inkjet recording apparatus for forming or recording an image on a recording medium.

2. Description of Related Art

An inkjet printer as a type of the inkjet recording apparatus is disclosed in JP-A-2006-131353. The inkjet printer includes an inkjet head having an ink ejection surface in which openings of a plurality of nozzles are arranged, a feeder belt, and a medium holder capable of accommodating a stack of recording media, which may be cut sheets of paper. Recording media stacked on the medium holder are one by one picked up from the medium holder and fed by the feeder belt to a position to be opposed to the ink ejection surface of the inkjet head. When each recording medium reaches this position, droplets of ink are ejected from the nozzle openings to form an image on the recording medium.

It is often the case that foreign matter, such as paper dust, is present on a recording medium. Hence, it may occur that during a recording medium is fed to the position to be opposed to the ink ejection surface after picked up from the medium holder, foreign matter on a surface of the recording medium departs from the surface and scatters around. Some of the foreign matter thus scattering may waft around the feeder belt and land on the ink ejection surface of the inkjet head, leading to closure of the nozzle openings or entrance of the foreign matter into the nozzles, which causes defect or failure in ejection of ink droplets. A remover can be disposed near the inkjet head in order to remove the foreign matter on the surface of the recording medium. However, it is impossible to perfectly remove the foreign matter from the surface of the recording medium with the remover, and a portion of the foreign matter inevitably scatters around. It is difficult to reliably inhibit the wafting foreign matter from landing on the ink ejection surface.

SUMMARY OF THE INVENTION

This invention has been developed in light of the above-described situations, and it is an object of the invention, therefore, to provide an inkjet recording apparatus which can reliably inhibit that foreign matter scattering from a surface of a recording medium lands on an ink ejection surface.

To attain the above object, the invention provides an inkjet recording apparatus including a feeding device, a medium supply device, a remover, and an inkjet head. The feeding device includes a plurality of belt rollers and an endless feeder belt wound around the belt rollers. An outer circumferential surface of the feeder belt functions as a feeding surface on which a recording medium is held while the recording medium is fed. The medium supply device makes the recording medium held on a downward-facing surface of the feeder belt with a recording surface of the recording medium facing downward. The downward-facing surface is a portion of the feeding surface which faces downward. The remover removes foreign matter on the recording surface of the recording medium as being held on the downward-facing surface. The inkjet head has a nozzle from which a droplet of ink is ejected onto the recording surface of the recording medium as being held on an upward-facing surface of the feeder belt. The upward-facing surface is a portion of the feeding surface which faces upward.

According to the invention, the foreign matter on the recording surface of the recording medium is removed by the remover while the recording medium is held on the downward-facing surface of the feeder belt with the recording surface facing downward. When the remover removes the foreign matter, a portion of the foreign matter scatters from the recording surface and wafts. The thus wafting foreign matter then falls downward below the feeder belt. Hence, the wafting foreign matter is inhibited with reliability from landing on the ink ejection surface of the inkjet head disposed above the upward-facing surface of the feeder belt.

A first preferable form of the inkjet recording apparatus further includes a recording-area cover which covers at least the inkjet head and an opposing surface of the feeder belt. The opposing surface is a portion of the upward-facing surface which is opposed to the inkjet head.

According to this form, the wafting foreign matter is further reliably inhibited from landing on the ink ejection surface of the inkjet head.

Further preferably, the inkjet recording apparatus further includes a positive-pressure keeper which holds positive an internal pressure of the recording-area cover.

According to this apparatus, an air flow is formed from an internal space of the recording-area cover to an external space thereof, and thus the wafting foreign matter is inhibited from entering the cover. Hence, the wafting foreign matter is further reliably inhibited from landing on the ink ejection surface of the inkjet head.

A second preferable form of the inkjet recording apparatus is such that the medium supply device includes a medium holder which accommodates a stack of the recording media, and a surface of each of the stack of recording media which faces upward is the recording surface from which the remover removes the foreign matter.

According to this form, even when dust is produced as the foreign matter upon the recording medium is supplied from the medium holder to the feeding device, the dust is removed by the remover.

A third preferable form of the inkjet recording apparatus is such that the medium supply device includes a medium holder and a pickup roller. The medium holder accommodates a stack of the recording media, and the pickup roller rotates while contacting a topmost one of the stack of the recording media accommodated in the medium holder, thereby supplying the topmost recording medium. The surface of the topmost recording medium with which the pickup roller contacts is the recording surface from which the remover removes the foreign matter.

Foreign matter or dust may be accumulated on the topmost one of the stack of the recording media while the inkjet recording apparatus is not in use. According to this form, such foreign matter or dust is removed by the remover.

A fourth preferable form of the inkjet recording apparatus further includes a dust tray and is such that the medium supply device includes a medium holder and a pickup roller. The medium holder accommodates a stack of the recording media. The pickup roller rotates while contacting a topmost one of the stack of the recording media accommodated in the medium holder, thereby supplying the topmost recording medium. The dust tray is disposed at a position apart from an upper surface of the topmost recording medium and covers the upper surface.

According to this form, it is prevented that foreign matter or dust is accumulated on the topmost recording medium while the inkjet recording apparatus is not in use.

BRIEF DESCRIPTION OF THE DRAWINGS

The above and other objects, features, advantages and technical and industrial significance of the present invention will be better understood by reading the following detailed description of preferred embodiments of the invention, when considered in connection with the accompanying drawings, in which.

DETAILED DESCRIPTION OF PREFERRED EMBODIMENTS

Hereinafter, there will be described an inkjet recording apparatus according to one presently preferred embodiment of the invention, by referring to the accompanying drawings.

Figure 1:
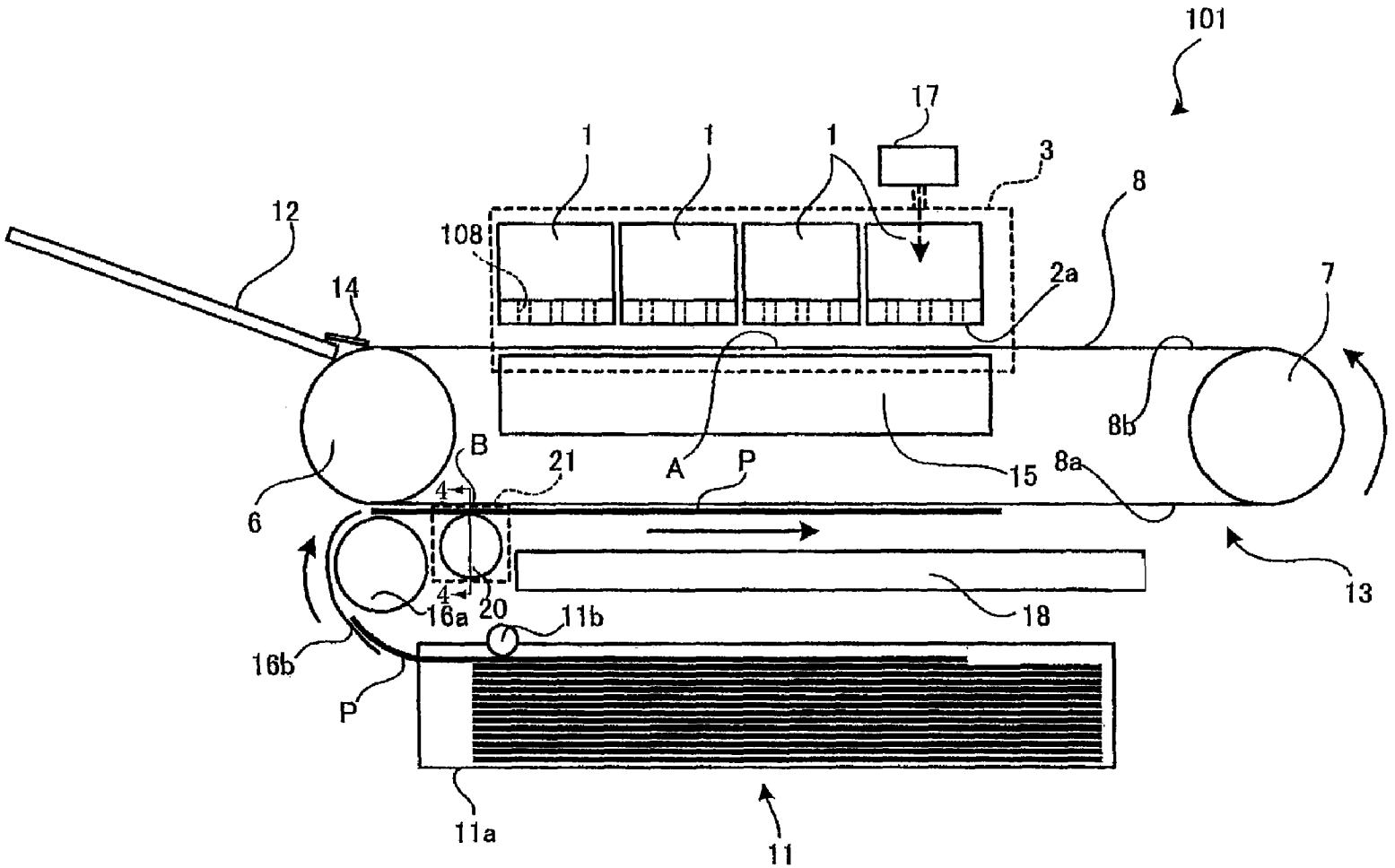
FIG. 1 is a schematic side view of an inkjet printer according to an embodiment of the invention.

In FIG. 1, reference numeral 101 generally denotes an inkjet printer as the inkjet recording apparatus according to the embodiment of the invention. The inkjet printer 101 has four inkjet heads 1, that is, the inkjet printer 101 is a color printer. Inside the inkjet printer 101 are disposed a sheet supply device 11 as a medium supply device, a remover roller 20 as a remover, a feeding device 13, and a catch tray 12, which 11, 20, 13, 12 are arranged in the order of description along a feed path of a cut sheet P of paper as one form of a recording medium. The feed path is indicated by solid arrows in FIG. 1.

The sheet supply device 11 includes a sheet holder 11*a* as a medium holder, a pickup roller 11*b*, and an inversion guide plate 16*b*. The sheet holder 11*a* accommodates a stack of cut sheets P. More specifically, the sheet holder 11*a* has a supporting surface on which a stack of cut sheets P is placed. The pickup roller 11*b* is driven by a motor (not shown) to pick up the cut sheets P in the sheet holder 11*a*, one by one from the topmost one, and feed out each cut sheet P leftward as seen in FIG. 1. The feeding device 13 is disposed over the sheet supply device 11, and the cut sheet P fed out by the pickup roller 11*b* is guided by the guide plate 16*b* to the feeding device 13. More specifically, guided by the guide plate 16*b*, the cut sheet P turns over and is fed out rightward as seen in FIG. 1. The cut sheet P is then fed onto a downward-facing surface of a feeder belt 8 of the feeding device 13, with a recording surface or recording surface of the cut sheet P facing downward.

The feeding device 13 receives the cut sheet P from the sheet supply device 11, and feeds the cut sheet P. The feeding device 13 includes the feeder belt 8, a platen 15, and a nip roller 16*a*. The feeder belt 8 is an endless belt wound around two belt rollers 6, 7, and the platen 15 is disposed inside a circle formed by the endless feeder belt 8 and opposed to the four inkjet heads 1. The nip roller 16*a* is disposed at an uppermost stream position in the feeding device 13 with respect to the feed path. The nip roller 16*a* and the belt roller 6 nips therebetween the cut sheet P coming from the lower side, such that the cut sheet P is placed on the downward-facing surface of the feeder belt 8. The nip roller 16*a* is provided by an elastic member and presses the cut sheet P against the feeder belt 8, thereby enabling to the feeder belt 8 to feed the cut sheet P downstream. That is, at least an outer circumferential surface, i.e., a feeding surface, of the feeder belt 8 is formed of silicone resin to give such a tackiness that the cut sheet P pressure-sensitively adheres to the downward-facing surface of the feeder belt 8 when pressed by the nip roller 16*a* against the feeder belt 8.

The platen 15 functions to support the feeder belt 8 such that a gap between the feeder belt 8 and the inkjet heads 1 is held constant at a region where the platen 15 is opposed to the inkjet heads 1. This prevents a vertical disposition of the feeder belt 8.

With rotation of a feeder motor (not shown), the belt roller 6 rotates to circulate the feeder belt 8. The cut sheet P on the feeder belt 8 is fed by the circulation of the feeder belt 8. First, the cut sheet P is fed rightward as seen in FIG. 1, at a segment of the feed path where the feeding surface faces downward. A part of the feeding surface corresponding to this segment will be referred to as "downward-facing surface". Then, the cut sheet P is turned over while being fed upward in accordance with the circulation of the feeder belt 8. Thereafter, the cut sheet P is fed leftward as seen in FIG. 1, at another segment of the feed path where the feeding surface faces upward. A part of the feeding surface corresponding to this segment will be referred to as "upward-facing surface 8*b*".

A separating plate 14 is disposed near a downstream end of the upward-facing surface 8*b* of the feeder belt 8. The cut sheet P fed by the feeder belt 8 is detached from the feeding surface of the feeder belt 8 by the separating plate 14 and ejected onto the catch tray 12, which is disposed downstream of the separating plate 14.

Figure 2:
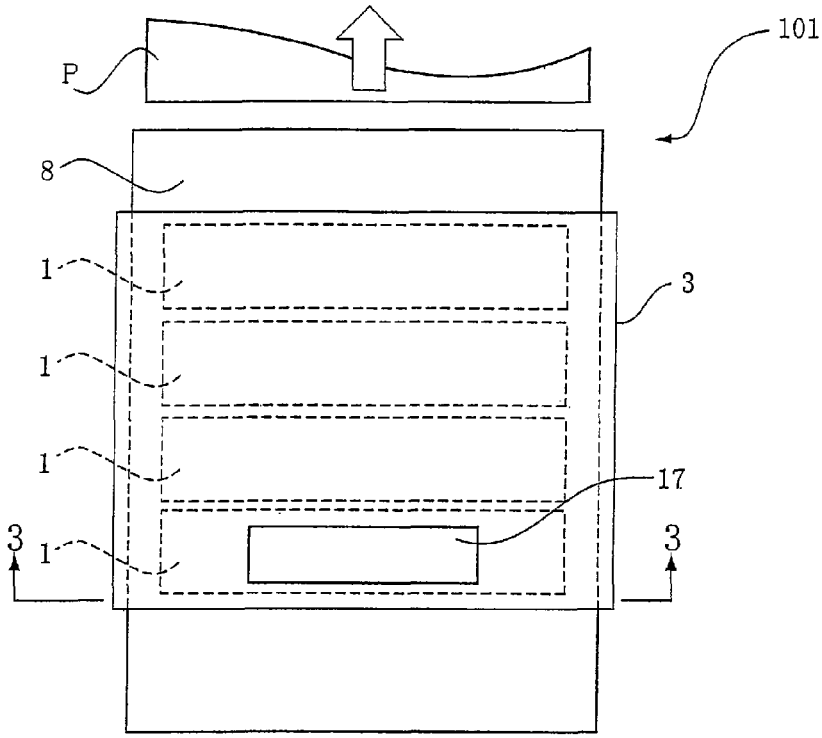
FIG. 2 is a top plan view of a relevant part of the inkjet printer.

Inside each of the inkjet heads 1 are formed ink passages each having a nozzle 108 from which an ink droplet is ejected. As FIG. 2A shows, the inkjet head 1 is a rectangular parallelepiped long in a direction perpendicular to a feeding direction in which the cut sheet P is fed under the inkjet heads 1. The white arrow in FIG. 2 indicates the feeding direction. The four inkjet heads 1 are for ejecting respective color inks (i.e., magenta, yellow, cyan, and black inks) and arranged along the feeding direction. Each inkjet head 1 is fixed to extend across the cut sheet P in the direction perpendicular to the feeding direction. That is, the inkjet printer 101 is a line printer. An under surface of the inkjet head 1 constitutes an ink ejection surface 2*a* in which a large number of nozzles 108 open. A plane surface in the upward-facing surface 8*b* of the feeder belt 8, which surface is opposed to the ink ejection surfaces 2*a* of the inkjet heads 1 and includes the feed path of the cut sheet P, corresponds to a recording area A. As the cut sheet P is fed by the feeder belt 8 and passes through the recording area A, i.e., just under the four inkjet heads 1, droplets of the color inks are sequentially ejected from the ink ejection surfaces 2*a* of the inkjet heads 1 toward the recording surface of the cut sheet P, in order to form or record a desired color image within a printing area in the cut sheet P.

A recording-area cover 3 is disposed to cover the inkjet heads 1 and a portion of the feeder belt 8 corresponding to the recording area A. A positive-pressure keeper 17 is attached to the recording-area cover 3, in order to keep positive an internal pressure of the recording-area cover 3. Thus, there is formed an air flow from an internal space of the recording-area cover 3 to an external space thereof, thereby preventing entrance of paper dust and ink mist into the recording-area cover 3.

Figure 3:
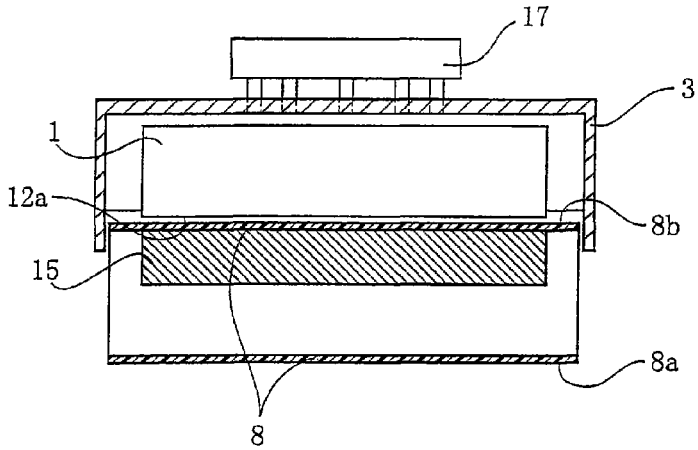
FIG. 3 is a cross-sectional view taken along line 3-3 in FIG. 2.

More specifically, the recording-area cover 3 has a substantially box-like shape open downward. The positive-pressure keeper 17 is disposed on an upstream portion of an upper surface of the recording-area cover 3, and operates to hold positive the pressure in the internal space defined between the recording-area cover 3 and the upward-facing surface 8*b* of the feeder belt 8. In this internal space are formed an air flow from upstream to downstream with respect to the feeding direction, and an air flow over the upward-facing surface 8*b* and widthwise with respect to the feeder belt 8 (i.e., in the direction perpendicular to the feeding direction). As FIG. 3 shows, two opposite side walls of the recording-area cover 3, which are respectively located beside widthwise ends of the feeder belt 8, extend downward to a level lower than the upward-facing surface 8*b* of the feeder belt 8 in order to direct the widthwise air flow to a level lower than the recording area A in the upward-facing surface 8*b*. Hence, even when foreign matter departs from the cut sheet P, the foreign matter is blown away from the recording area A and inhibited from landing back on the cut sheet P, or on the ink ejection surfaces 2*a* of the inkjet heads 1, at the recording area A.

As the cut sheet P is fed, foreign matter including that departing from the cut sheet P may be introduced into the recording area A. When such introduction of foreign matter to the recording area A occurs, the foreign matter tends to be deposited or land again on the cut sheet P or the ink ejection surfaces 2*a* more highly at an upstream portion of the recording area A. The provision of the air into the recording-area cover 3 from the upstream side by means of the positive-pressure keeper 17 effectively prevents the landing of foreign matter on the cut sheet P and the ink ejection surfaces 2*a*.

The remover roller 20 operates to remove the foreign matter such as paper dust from the recording surface of the cut sheet P being fed. The remover roller 20 is disposed near an upstream end of the downward-facing surface of the feeder belt 8 and opposed to the downward-facing surface. In the present embodiment, the remover roller 20 is positioned downstream of the nip roller 16*a*, and contacts the cut sheet P over the whole width of the cut sheet P. An area in the downward-facing surface which is opposed to the remover roller 20 constitutes a removing area B at which the foreign matter is removed from the recording surface of the cut sheet P.

An outer circumferential surface of the remover roller 20 has such a tackiness that when the outer circumferential surface of the remover roller 20 contacts the recording surface of the cut sheet P held on the downward-facing surface of the feeder belt 8, the foreign matter, such as paper dust, on the recording surface is moved away from the cut sheet P onto the remover roller 20. More specifically, the tackiness of the outer circumferential surface of the remover roller 20 is set at a sufficiently small value with respect to the tackiness of the feeding surface of the feeder belt 8 such that contact between the outer circumferential surface of the remover roller 20 and the cut sheet P does not cause detachment of the cut sheet P from the feeding surface of the feeder belt 8. However, this does not necessarily mean that the tackiness of the outer circumferential surface of the remover roller 20 per unit area is smaller than that of the feeding surface of the feeder belt 8. For instance, the tackiness per unit area may be equal therebetween. That is, an area at which the feeding surface of the feeder belt 8 contacts the cut sheet P is relatively wide whereas the outer circumferential surface of the remover roller 20 contacts the cut sheet P at a partial cylindrical surface which is relatively narrow, and equality in tackiness per unit area between the outer circumferential surface of the remover roller 20 and the feeding surface of the feeder belt 8 does not result in detachment of the cut sheet P from the feeding surface of the feeder belt 8. However, where the tackiness of the outer circumferential surface of the remover roller 20 per unit area is smaller than that of the feeding surface of the feeder belt 8, detachment of the cut sheet P from the feeding surface is inhibited with more reliability.

Figure 4:
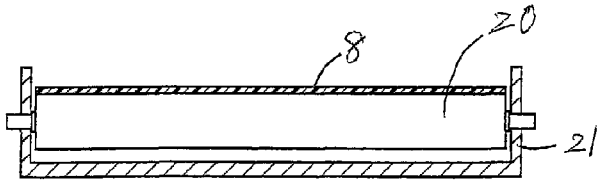
FIG. 4 is a cross-sectional view taken along line 4-4 in FIG. 1.

A removing-area cover 21 (shown in cross section in FIG. 4) is disposed to cover the remover roller 20 and a part of the feeder belt 8 which includes a portion corresponding to the removing area B. Hence, the foreign matter departing from the recording surface is prevented from scattering around.

In place of the remover roller 20, other kinds of removers may be employed. For instance, a rotatable brush may be employed. Where a rotatable brush is employed, it is significant to dispose the removing-area cover 21 in order to prevent that the foreign matter scattering around from the cut sheet P lands on the ink ejection surfaces of the inkjet heads 1 or back onto the cut sheet P. Alternatively, an antistatic brush may be employed in place of the remover roller 20. Where an antistatic brush is employed, static electricity as well as foreign matter is eliminated from the cut sheet P.

A dust tray 18 is disposed downstream of the remover roller 20 and opposed to the downward-facing surface of the feeder belt 8. The dust tray 18 receives the foreign matter scattering or falling from the recording surface of the cut sheet P. Foreign matter wafting inside the inkjet printer 101 often coalesces with ink mist and grows into particles so heavy as to naturally fall. The dust tray 18 receives such falling objects and thus contributes to preventing contamination inside the inkjet printer 101.

As described above, the cut sheet P is fed out from the sheet holder 11*a* of the sheet supply device 11 leftward as seen in FIG. 1, by the pickup roller 11*b*. As the cut sheet P goes upward along the guide plate 16*b* thereafter, the cut sheet P turns over. Thereafter, the cut sheet P is fed rightward as seen in FIG. 1 into the feeding device 13 such that the cut sheet P is pressed against the downward-facing surface of the feeder belt 8 by the nip roller 16*a*. Thus, the cut sheet P is then fed rightward as seen in FIG. 1 while pressure-sensitively adhering to the downward-facing surface with the recording surface thereof facing downward. During the rightward feeding of the cut sheet P, the cut sheet P passes the removing area B at which the foreign matter on the recording surface of the cut sheet P is removed by the remover roller 20. Thereafter, the cut sheet P is fed upward while being turned over, in accordance with the circulation of the feeder belt 8. The cut sheet P is then fed leftward as seen in FIG. 1, with a part of the feeding surface at which the cut sheet P is held constituting the upward-facing surface 8*b*. During the cut sheet P is passing just under the four inkjet heads 1, that is, during the cut sheet P is fed across the recording area A, droplets of the color inks are ejected from the respective ink ejection surfaces 2*a* toward the recording surface of the cut sheet P, whereby a desired color image is formed or recorded within the printing area of the cut sheet P. The formation or recording of the image is implemented in a state where the recording-area cover 3 and the positive-pressure keeper 17 disposed on the upper surface of the recording-area cover 3 inhibit that the foreign matter departing from the cut sheet P and scattering lands on the cut sheet P or the ink ejection surfaces. Then, the cut sheet P is detached from the feeding surface of the feeder belt 8 by the separating plate 14 and ejected onto the catch tray 12 located on the left side of the feeder belt 8 as seen in FIG. 1.

According to the embodiment described above, the foreign matter on the recording surface of the cut sheet P is removed by the remover roller 20 while the cut sheet P pressure-sensitively adheres to the downward-facing surface of the feeder belt 8 with the recording surface thereof facing downward. A portion of the foreign matter may scatter upon the removal, but the foreign matter thus scattering falls downward below the feeder belt 8. Hence, the scattering foreign matter is reliably inhibited from landing on the ink ejection surfaces 2*a* of the inkjet heads 1 which are located above the upward-facing surface 8*b* of the feeder belt 8.

Since the inkjet heads 1 and a portion of the feeder belt 8 corresponding to the recording area A are covered by the recording-area cover 3, the scattering foreign matter is further reliably inhibited from landing on the ink ejection surfaces 2*a*.

Since the positive-pressure keeper 17 holds positive the internal pressure of the recording-area cover 3, an air flow is generated from the internal space of the recording-area cover 3 to the external space thereof, thereby preventing entrance of the scattering foreign matter into the recording-area cover 3. Thus, landing of the foreign matter on the ink ejection surfaces 2*a* is further reliably inhibited.

Since the remover roller 20 and a portion of the feeder belt 8 corresponding to the removing area B are covered by the removing-area cover 21, the foreign matter departing from the recording surface of the cut sheet P is prevented from scattering around.

Although there has been described one embodiment of the invention, it is to be understood that the invention is not limited to the details of the embodiment but may be otherwise embodied with various modifications and improvements that may occur to those skilled in the art, without departing from the scope and spirit of the invention defined in the appended claims.

For instance, in the above-described embodiment the recording-area cover 3 covers only the inkjet heads 1 and a part of the feeder belt 8 which includes the portion corresponding to the recording area A. However, the recording-area cover 3 may further cover the upward-facing surface 8*b* of the feeder belt 8 and another area over the upward-facing surface 8*b*. Alternatively, the recording-area cover 3 may be omitted.

Although in the above-described embodiment the inkjet printer 101 includes the positive-pressure keeper 17 that keeps positive the internal pressure of the recording-area cover 3. However, such a positive-pressure keeper 17 may be omitted.

In the above-described embodiment, the removing-area cover 21 covers only the remover roller 20 and a part of the feeder belt 8 which includes the portion corresponding to the removing area B. However, the removing-area cover 21 may further cover another area of the feeder belt 8 except the upward-facing surface 8*b*. Alternatively, the removing-area cover 21 may be omitted.

The remover roller 20 in the above-described embodiment removes the foreign matter on the cut sheet P by way of its contact with the cut sheet P over the whole width of the cut sheet P. However, the embodiment may be modified such that the remover roller 20 contacts only opposite widthwise ends of the cut sheet P. This also applies where a remover other than a roller is employed. That is, since paper dust tends to occur at opposite widthwise ends of a cut sheet of paper, cleansing merely the opposite widthwise ends is effective to sufficiently inhibit landing of paper dust on the ink ejection surfaces 2*a*.

The cut sheet P as a recording medium can be easily held on the outer circumferential surface or the feeding surface of the feeder belt 8 where the feeding surface has a tackiness, as in the above-described embodiment. However, the way of holding the cut sheet P on the feeding surface is not limited to that described above. For instance, it may be arranged such that the feeder belt 8 is formed of a material having an air permeability, and the air is sucked through the feeder belt 8 from an inner circumferential side of the feeder belt 8 in order to hold the cut sheet P on the feeding surface of the feeder belt 8.

Although the inkjet printer 101 of the embodiment is a line printer, the invention is applicable to other types of inkjet printers, such as serial printer.

It is noted that although in the above-described embodiment the positive-pressure keeper 17 is disposed on the upper surface of the recording-area cover 3, the positive-pressure keeper 17 may be disposed at other positions in the printer. Where the positive-pressure keeper 17 is disposed at other positions in the printer, it may be arranged such that an air positively pressurized is supplied to the internal space of the recording-area cover 3 through a tube.

What is claimed is:

1. An inkjet recording apparatus comprising:

a feeding device including:

a plurality of belt rollers; and an endless feeder belt which is wound around the belt rollers and which has an outer circumferential surface comprising a downward-facing surface and an upward-facing surface both of which hold a recording medium to feed the recording medium;

a medium supply device which makes the recording medium held on the downward-facing surface of the feeder belt with a recording surface of the recording medium facing downward, the downward-facing surface being a portion of the outer circumferential surface which portion faces downward and extends from the lowest end of one of the belt rollers to the lowest end of another of the belt rollers;

a remover which removes foreign matter on the recording surface of the recording medium as being held on the downward-facing surface and which is opposed to the downward-facing surface; and an inkjet head which has a nozzle from which a droplet of ink is ejected onto the recording surface of the recording medium as being held on the upward-facing surface of the feeder belt, the upward-facing surface being a portion of the outer circumferential surface which faces upward.

2. The inkjet recording apparatus according to claim 1, wherein the outer circumferential surface of the feeder belt has a tackiness which enables the outer circumferential surface to hold the recording medium thereon.

3. The inkjet recording apparatus according to claim 1, further comprising a recording-area cover which covers at least the inkjet head and an opposing surface of the feeder belt, the opposing surface being a portion of the upward-facing surface which is opposed to the inkjet head.

4. The inkjet recording apparatus according to claim 3, wherein the recording-area cover has a pair of opposite side walls respectively extending beside opposite widthwise ends of a portion of the feeder belt which constitutes the upward-facing surface, down to a level lower than the portion of the feeder belt.

5. The inkjet recording apparatus according to claim 3, further comprising a positive-pressure keeper which holds positive an internal pressure of the recording-area cover.

6. The inkjet recording apparatus according to claim 1, wherein the medium supply device includes:

a medium holder which accommodates a stack of the recording media;

a pickup roller which rotates while contacting a topmost one of the stack of the recording media accommodated in the medium holder, thereby supplying the topmost recording medium; and a pair of nip rollers which makes the recording medium as supplied by the pickup roller be held on the feeder belt.

7. The inkjet recording apparatus according to claim 6, wherein one of the nip rollers is provided by one of the belt rollers around which the feeder belt is wound.

8. The inkjet recording apparatus according to claim 6, further comprising an inversion guide which guides the recording medium as supplied by the pickup roller, to the feeder belt in a U-turn manner such that the recording medium is turned over.

9. The inkjet recording apparatus according to claim 6, wherein a supporting surface of the medium holder and the upward-facing surface of the feeder belt are substantially parallel to each other.

10. The inkjet recording apparatus according to claim 1, further comprising a dust tray which is disposed under the downward-facing surface of the feeder belt and opposed to the downward-facing surface, and receives foreign matter departing from the recording medium.

11. The inkjet recording apparatus according to claim 1, further comprising a removing-area cover which covers at least the remover and a portion of the outer circumferential surface of the feeder belt which corresponds to a removing area at which the outer circumferential surface is opposed to the remover.

12. The inkjet recording apparatus according to claim 1, wherein the remover is disposed under the feeder belt such that the whole remover is within an area of the feeder belt as seen in a vertical direction.

13. The inkjet recording apparatus according to claim 1, wherein the remover includes a remover roller which contacts at an outer surface thereof the downward-facing surface of the feeder belt in order to be rotated with circulation of the feeder belt, the outer surface of the remover roller having a tackiness.

14. The inkjet recording apparatus according to claim 1, wherein the plurality of belt rollers are two belt rollers.

15. The inkjet recording apparatus according to claim 1, wherein the medium supply device includes a medium holder which accommodates a stack of the recording media, and a surface of each of the stack of the recording media which faces upward is the recording surface from which the remover removes the foreign matter.

16. The inkjet recording apparatus according to claim 1, wherein the medium supply device includes:

a medium holder which accommodates a stack of the recording media; and a pickup roller which rotates while contacting a topmost one of the stack of the recording media accommodated in the medium holder, thereby supplying the topmost recording medium, the surface of the topmost recording medium with which the pickup roller contacts is the recording surface from which the remover removes the foreign matter.

17. The inkjet recording apparatus according to claim 1, wherein the medium supply device includes:

a medium holder which accommodates a stack of the recording media; and a pickup roller which rotates while contacting a topmost one of the stack of the recording media accommodated in the medium holder, thereby supplying the topmost recording medium, the inkjet recording apparatus further comprising a dust tray which is disposed at a position apart from an upper surface of the topmost recording medium and covers the upper surface.

18. The inkjet recording apparatus according to claim 1, wherein the feeder belt is configured to feed the recording medium at least from a position where the recording medium is held on the downward-facing surface to another position where the recording medium is held on the upward-facing surface.

19. The inkjet recording apparatus according to claim 1, wherein the remover is disposed at an upstream end, in a feeding direction of the recording medium, of the downward-facing surface of the feeder belt.

20. The inkjet recording apparatus according to claim 5, wherein the positive pressure keeper is disposed at an upstream portion, in a feeding direction of the recording medium, of the recording-area cover.

21. The inkjet recording apparatus according to claim 1, wherein the upward-facing surface is the portion of the outer circumferential surface, which portion faces upward and extends from the uppermost end of one of the belt rollers to the uppermost end of another of the belt rollers.

* * * * *